United States Patent [19]

Frankland

[11] 4,317,062

[45] Feb. 23, 1982

[54] VALVE MEANS AND MERCURY RESERVOIR FOR GAS DISCHARGE DISPLAY

[75] Inventor: Roger A. Frankland, Scottsdale, Ariz.

[73] Assignee: Beckman Instruments, Inc., Fullerton, Calif.

[21] Appl. No.: 64,156

[22] Filed: Aug. 6, 1979

[51] Int. Cl.[3] ..... H01J 17/49; H01J 61/28

[52] U.S. Cl. ..... 313/175; 313/177

[58] Field of Search ..... 313/175, 177, 174

[56] References Cited

U.S. PATENT DOCUMENTS

| | | | |
|---|---|---|---|
| 745,427 | 12/1903 | Emonds | 313/175 X |
| 1,010,670 | 12/1911 | Moore . | |
| 1,055,185 | 3/1913 | Kent et al. . | |
| 3,580,654 | 5/1971 | Kupsky | 316/20 |
| 3,784,862 | 1/1974 | Yoshitoshi et al. | 313/174 |
| 3,828,218 | 8/1974 | Fehnel | 313/177 |
| 3,872,339 | 3/1975 | Maloney | 313/174 X |
| 3,886,388 | 5/1975 | Paine, Jr. et al. | 313/174 X |
| 3,944,869 | 3/1976 | Przybylek | 313/177 X |
| 3,947,713 | 3/1976 | Przybylek | 313/174 |

*Primary Examiner*—Palmer C. Demeo

*Attorney, Agent, or Firm*—R. J. Steinmeyer; F. L. Mehlhoff; William H. May

[57] ABSTRACT

A gas discharge display having valve means comprising a pellet cooperating with a conical opening of a base plate of a display panel, the valve means allowing the continuous introduction of mercury vapor from a liquid mercury reservoir to the envelope of the display, but preventing the entrance of liquid mercury.

6 Claims, 2 Drawing Figures

VALVE MEANS AND MERCURY RESERVOIR FOR GAS DISCHARGE DISPLAY

BACKGROUND OF THE INVENTION

The present invention is directed to gas discharge displays, and more particularly, to the method and means for introducing mercury vapor into the gas envelope of the display. Mercury vapor is introduced to minimize cathode sputtering which is a typical phenomenon. Displays can also be operated at a higher current level and they have a longer life when mercury vapor is utilized. However, it is undesirable to have liquid mercury in the display panel, for this may cause shorting of adjacent electrodes, the formation of local hot spots and a discoloration of the transparent viewing surfaces. It is a goal to provide mercury vapor to the display without introducing liquid mercury into the display.

The prior art has numerous references which teach various methods and means for introduction of mercury vapor to the display. One method is to encapsulate liquid mercury in a small glass capsule which is situated within the actual display. At the time when mercury vapor is desired, energy of some form is supplied to the display causing the capsule to rupture and release mercury vapor and liquid mercury into the display. Although this method does provide the desired mercury vapor, it has the disadvantage of introducing liquid mercury directly into the display.

Attention is directed to U.S. Pat. Nos. 3,828,218, hereinafter referred to as Fehnel, and 3,872,339, hereinafter referred to as Maloney. Fehnel provides means for the introduction of mercury vapor to the display panel and is described in the abstract. "The panel includes a tubulation secured to the base plate through which gas and mercury vapor are introduced into the panel through a hole in the panel base plate. A fine mesh nickel screen is disposed in the tubulation adjacent to the hole in the base plate to prevent an excess of free mercury from entering the panel and, at the same time, to provide a source of mercury by way of the mercury which amalgamates with the screen." The use of the nickel screen to prevent liquid mercury from entering the display causes many problems. The metal mesh can be a source of contamination which leads to contamination of the display. At elevated temperatures drops of liquid mercury can pass through the mesh screen and enter the display. The mesh is always semi-open and cannot completely close off the display. It is difficult to seal the metal mesh to a glass surface such as the base plate, and it is difficult to evacuate the display when the metal mesh is secured to the base plate since the evacuation must occur through the actual mesh screen.

Maloney is very similar to Fehnel and is described in the abstract. "The panel includes a tubulation secured to the base plate through which gas and mercury vapor are introduced into the panel through a hole in the panel base plate. A mass of fibrous material is disposed in the tubulation adjacent to the hole in the base plate to prevent globules of free mercury from entering the panel and, at the same time, permitting mercury vapor to enter the panel." Maloney suffers from all of the disadvantages of Fehnel. The fibrous material can be a source of contamination, and at elevated temperatures droplets of liquid mercury could pass through the fibrous material into the display. The fibrous material is always semi-open and cannot completely close off the display. Means must be employed to hold the fibrous material in place, and it is difficult to evacuate the display when the fibrous material is in place since the evacuation must proceed through the fibrous material.

The preceding cited patents provide means which allow the introduction of mercury vapor while attempting to limit the entrance of liquid mercury into the display. However, these patents are subject to problems and difficulties which the present invention seeks to overcome. A significant problem with prior arrangements is to make a hole small enough leading into the sealed envelope to prevent the entrance of liquid mercury. Typically a hole in the range of 1–2 mils is needed to prevent the entrance of liquid mercury. Consequently, most arrangements utilize some blocking mechanism over the hole.

SUMMARY OF THE INVENTION

The instant invention provides means for introducing a continuous supply of mercury vapor to the display of a gas discharge display while preventing the entrance of any liquid mercury from a mercury reservoir into the display. This is accomplished by securing a reservoir providing chamber on the base plate of the display adjacent an aperture in the base plate. The chamber is designed to contain liquid mercury and valve means are incorporated in the chamber to cooperate with the aperture of the base plate to control the flow of gas between the reservoir providing chamber and the envelope via the base plate aperture or opening.

The valve means does not create a source of contamination to the display, and does not permit the entrance of liquid mercury to the display at elevated temperatures. The valve means can be opened to allow easier evacuation of the display with subsequent introduction of gas. Use of valve means in the present invention provides a small opening, e.g., 1–2 mils, for the introduction of mercury vapor, and prevents the entrance of mercury particles into the display.

The use of valve means such as described herein is less costly than methods previously reported in the prior art and eliminates many of the problems encountered therein. The valve means of the present invention does not create a source of contamination to the display and does not allow liquid mercury to enter the display at elevated temperatures. Because the present valve means eliminates problems encountered in sealing a mesh screen or fibrous material to a glass base plate, easier evacuation of the display is permitted with subsequent introduction of gas pursuant to an ability to open the valve.

DESCRIPTION OF THE PREFERRED EMBODIMENTS

The principles of the invention are useful with substantially any device in which the introduction of mercury vapor is desired. For purposes of illustration, a planar gas discharge device, is described herein.

Figure 1:
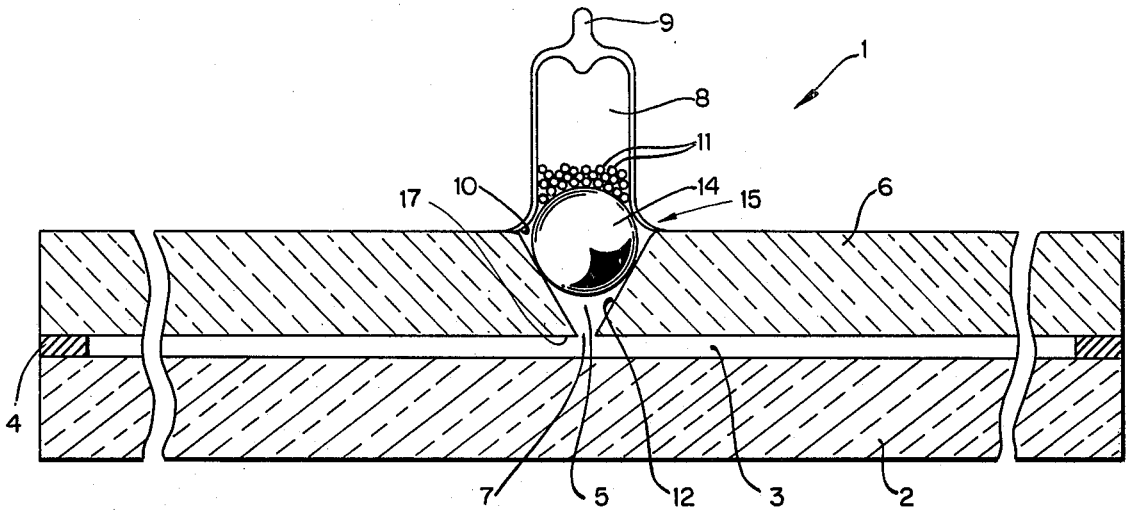
FIG. 1 is a sectional view of a gas discharge display panel embodying the present invention, with the discharge display panel in a horizontal position, showing the valve in a closed position.

As shown in FIG. 1, display device 1 includes a base plate 6, made of an insulating material such as glass or ceramic, and a transparent face plate 2, made of glass. The two plates are hermetically sealed by a sealing frit 4 to form an enclosed envelope 3. Located within the envelope 3 are one or more cathode electrodes, not shown, which operate in conjunction with one or more anode electrodes, not shown. An ionizable gas is introduced into the envelope 3. The application of a potential between the electrodes will cause the ionizable gas to glow over the electrically addressed cathode electrodes to produce a visible message.

Valve means 15 within an opening 5 in base plate 6 is provided. Extending adjacent to opening 5 is a reservoir providing chamber 8 containing a supply of liquid mercury 11. Valve means 15 permits mercury vapor from the liquid mercury 11 to pass into envelope 3, but prevents liquid mercury from entering. Valve means 15 is designed in a manner which allows the valve to be in an open position when desired, creating an open passageway 19 from envelope 3 to the chamber 8.

The base plate 6 of display 1 contains valve means comprised of spherical pellet 14 touching interior wall 12 of opening 5. Opening 5 is preferably in the form of a conical opening and is created as a result of boring or sandblasting base plate 6, forming aperture 7 at the junction of conical opening 5 with the inside surface 17 of the base plate 6. Pellet 14 is composed generally of any hard dense material, such as glass, which will not react with mercury to effect a chemical change. Liquid mercury 11 is contained within reservoir providing chamber 8 which is preferably formed from a piece of glass tubulation. Chamber 8 is hermetically sealed to base plate 6 at 10 and the end of chamber 8 is flared in such a manner that the movement of pellet 14 is limited to approximately 0.010–0.020 of an inch. Pellet 14 touching wall 12 effectively prevents liquid mercury in chamber 8 from entering envelope 3 via aperture 7, but does not prevent mercury vapor from entering.

The slope of opening 5, diameter of aperture 7 and diameter of pellet 14 may vary. However, a slope equivalent to a 45° angle, aperture diameter between about 0.2 inches at the large end and pellet diameter of approximately 0.175 inch have been found to be effective.

The combination of mercury vapor with the ionizable gas apparently minimizes cathode sputtering; however, liquid mercury in the envelope 3 degrades the quality of the display and is to be avoided. The present invention through the use of valve means 15 permits the entrance of mercury vapor from chamber 8 into envelope 3, but prevents the entrance of liquid mercury into the envelope.

Figure 2:
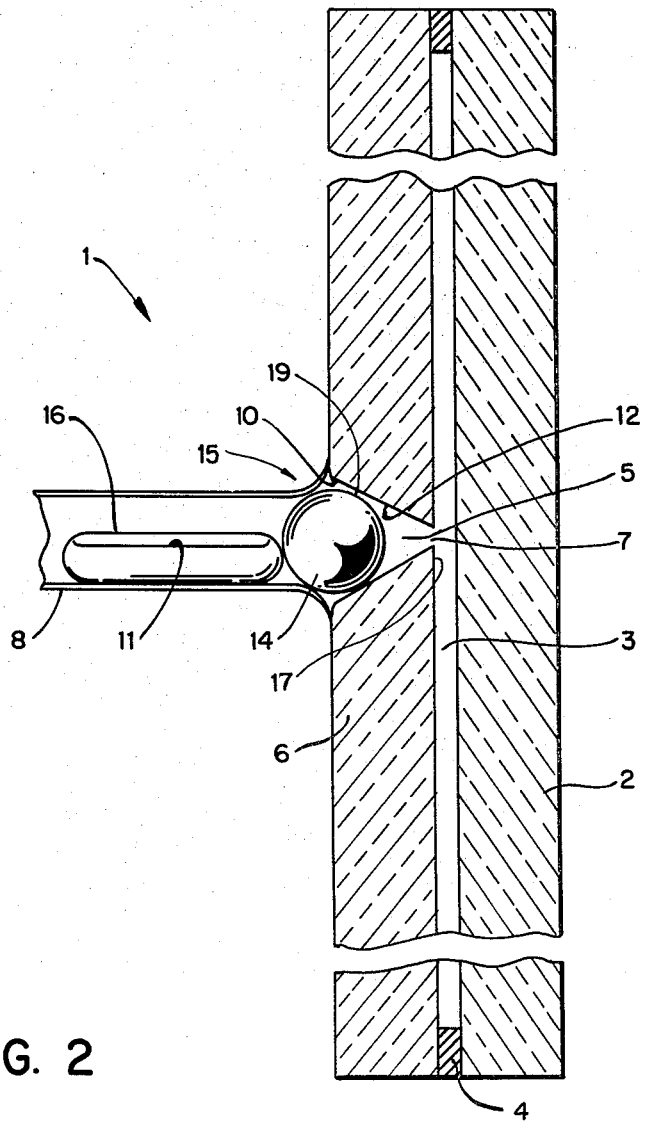
FIG. 2 is a sectional view of a gas discharge display panel embodying the present invention with the discharge display panel in a vertical position, showing the valve in an open position prior to sealing the display off from outside atmosphere.

FIG. 2 depicts an intermediate stage in the manufacture of display 1 showing a sectional view of the display with the display tilted to a vertical position. In this position, the valve means is in an open position. Capsule 16 contains liquid mercury 11 and is placed in chamber 8 after chamber 8 is hermetically sealed to base plate 6 with chamber 8 being open ended. Capsule 16 is composed generally of glass and contains approximately 3 mg of mercury. Prior to sealing the other end of chamber 8, the air within envelope 3, opening 5 and chamber 8 is evacuated and an ionizable gas is introduced. For this purpose, valve 15 is opened, allowing the easier removal of air and introduction of ionizable gas. Again referring to FIG. 2, pellet 14 is shown displaced away from the surface of the conical opening 5, creating an open passageway 19 from envelope 3 to chamber 8. With valve 15 in this position, vacuum means are then attached to chamber 8 and the display is evacuated through passageway 19 while it is heated. Heating is necessary to remove any atmospheric moisture which has adhered to the surfaces of display elements. When evacuation is complete, gas port means are attached to chamber 8 and an ionizable gas introduced. This also occurs with valve 15 in the open position. Chamber 8 is first sealed at a point remote from the back of the display and air is precluded from entering the display. Energy such as heat is then supplied to chamber 8 causing capsule 16 to rupture, releasing mercury 11. Rupturing capsule 16 occurs preferably with valve 15 in a closed position. Chamber 8 is then sealed a second time, at point 9 (in FIG. 1), which is closer to the back of the display than the first seal.

Mercury vapor enters envelope 3 even when valve means 15 is closed, due to surface irregularities of wall 12 and pellet 14. When valve means 15 is in an open position, an open passageway 19 permits mercury vapor to enter envelope 3 but liquid mercury is prevented from entering. The movement of pellet 14 is limited so that whatever the position of the display, liquid mercury from reservoir 11 is prevented from entering envelope 3. Thus the display is portable and can be transported without danger of liquid mercury contamination. During normal operation of the display, the display is in a vertical position with the valve means in an open position, creating passageway 19.

As is apparent, the specific embodiments described herein may be altered and changed by those skilled in the art without departing from the true spirit and scope of the invention which is described in the appended claims.

What is claimed is:

1. A display device comprising:

a base plate with an opening;

a face plate sealed to the base plate in such a manner as to create an envelope between the two plates;

one or more cathode and anode electrodes within the envelope;

an ionizable gas contained within the envelope;

a reservoir providing chamber secured to the base plate adjacent the opening in the base plate, the chamber containing liquid mercury; and movable valve means seating in the opening of the base plate, said valve means blocking the passage of liquid mercury and allowing the passage of mercury vapor from said chamber to said envelope via said opening.

2. The device as defined in claim 1, wherein the opening in the base plate is in the form of a conical opening, narrowing as the opening approaches the envelope.

3. A display device comprising:

a base plate with a conical opening;

a face plate sealed to said base plate in such a manner as to create an envelope between said two plates;

one or more cathode and anode electrodes within said envelope;

an ionizable gas contained within said envelope;

a reservoir providing chamber secured to said base plate adjacent said opening in said base plate, said chamber containing liquid mercury; and a spherical pellet cooperating with said opening of said base plate for controlling the flow of mercury vapor between said chamber and said envelope via said opening for preventing the entry of liquid mercury into said envelope, wherein said spherical pellet has a diameter larger than the smallest diameter of the opening, with the pellet touching the wall of the conical opening.

4. The device as defined in claim 3, wherein the pellet is comprised of a dense, hard substance which does not react chemically with mercury.

5. A display device comprising:

a base plate with a conical opening;

a face plate sealed to the base plate in such a manner as to create an envelope between the two plates;

one or more cathode and anode electrodes within the envelope;

an ionizable gas contained within the envelope;

mercury vapor contained within the envelope;

a reservoir providing chamber secured to the base plate adjacent to the opening in the base plate, the chamber containing liquid mercury; and a spherical pellet having a diameter larger than the smallest diameter of the opening, the pellet being in a close proximate relationship with the conical opening as to permit the flow of mercury vapor from the liquid mercury to the envelope via surface irregularities of the pellet and the conical opening.

6. The device as defined in claim 5 wherein the pellet is comprised of a dense, hard substance that does not react with mercury to effect a chemical change.

* * * * *